US007451822B2

(12) United States Patent
Deul

(10) Patent No.: US 7,451,822 B2
(45) Date of Patent: Nov. 18, 2008

(54) METHOD FOR RETRIEVING RISER FOR STORM EVACUATION

(75) Inventor: Hans H. J. Deul, Richmond, TX (US)

(73) Assignee: Noble Drilling Services Inc., Sugar Land, TX (US)

( * ) Notice: Subject to any disclaimer, the term of this patent is extended or adjusted under 35 U.S.C. 154(b) by 176 days.

(21) Appl. No.: 11/430,600

(22) Filed: May 9, 2006

(65) Prior Publication Data

US 2007/0261856 A1 Nov. 15, 2007

(51) Int. Cl.
*E21B 43/36* (2006.01)

(52) U.S. Cl. ..... 166/359; 166/339; 166/364; 166/365

(58) Field of Classification Search ..... 166/339, 166/340, 350, 358, 359, 364, 365, 367
See application file for complete search history.

(56) References Cited

U.S. PATENT DOCUMENTS 3,330,340 A * 7/1967 Hayes et al. ..... 166/340
3,858,401 A * 1/1975 Watkins ..... 405/224.2
3,999,617 A * 12/1976 Ilfrey et al. ..... 175/7
4,081,039 A * 3/1978 Wardlaw ..... 175/7
4,194,568 A * 3/1980 Buresi et al. ..... 166/340
4,646,840 A * 3/1987 Bartholomew et al. ..... 166/350
4,913,238 A * 4/1990 Danazcko et al. ..... 405/223.1
5,046,896 A * 9/1991 Cole ..... 405/195.1
5,657,823 A * 8/1997 Kogure et al. ..... 166/340
5,676,209 A * 10/1997 Reynolds ..... 166/345
6,004,074 A * 12/1999 Shanks, II ..... 405/195.1
6,155,748 A * 12/2000 Allen et al. ..... 405/195.1
6,267,537 B1 * 7/2001 Breivik et al. ..... 405/171
6,402,430 B1 * 6/2002 Guesnon ..... 405/224.2

* cited by examiner

*Primary Examiner*—Thomas A Beach
*Assistant Examiner*—Matthew R Buck
(74) *Attorney, Agent, or Firm*—Richard A. Fagin

(57) ABSTRACT

A method for preparing to move a floating structure away from a wellbore drilled below the bottom of a body of water includes filling a riser extending from the bottom of the body of water to the floating structure with water. The water in the riser is displaced to a selected first depth below the water surface. The riser is sealed at a second selected depth shallower than the first selected depth. The portion of the riser above the second selected depth is withdrawn onto the floating structure.

18 Claims, 2 Drawing Sheets

METHOD FOR RETRIEVING RISER FOR STORM EVACUATION

CROSS REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of floating petroleum drilling and production systems. More specifically, the invention relates to methods for retrieving part of a riser connecting a wellbore to a floating platform such that the platform can be moved in preparation for adverse weather conditions.

2. Background Art

Floating structures are known in the art for drilling wellbores in Earth formations located below the ocean floor, and for producing petroleum from such wellbores. The wellbores are typically drilled using fluid pressure control equipment, called a "blowout preventer" (BOP) affixed to the top of a casing cemented into a relatively shallow portion of the wellbore. A "riser", which is a pipe formed from segments coupled end to end, is affixed to the top of the BOP and extends therefrom to the floating platform. The riser provides a conduit for fluids to move from the wellbore upwardly to the floating platform. Therefore a riser as used in wellbore drilling forms a conduit for drilling fluid and drill cuttings to be returned to the floating platform for processing and recirculation into the wellbore.

A riser is assembled to the wellbore from the floating platform by coupling together segments, called "joints" of riser, and moving the assembled "string" of joints of riser downward from the floating platform as successive riser joints are coupled to the string on the platform. The foregoing procedure continues until the riser is long enough to reach the wellbore from the floating platform, whereupon the lowermost end of the riser is coupled to the BOP.

During the approach of severely adverse weather conditions, such as a tropical cyclone (hurricane or typhoon), safety considerations require preparing the well for the possibility that the floating structure will be moved from its location, either by, or intentionally to avoid, the force of such weather conditions. In preparation for such weather conditions, it is necessary to retrieve the riser from the wellbore. Retrieving the riser includes lifting the riser and consecutively disassembling joints from the remaining riser string as it is suspended from the floating platform in the water. The disassembly continued until all the riser is disassembled and is retrieved from the water. Retrieving the riser is a time consuming and therefore costly procedure, the time and cost of which is related to the depth of water in which the well is being operated. Further, because of the amount of time needed to retrieve the riser, it is necessary to begin retrieval thereof at such a time prior to the expected arrival of such weather conditions as to make it more likely that the adverse weather conditions do not in fact approach the location of the floating platform. Thus, in a number of instances, retrieving the riser proves to be unnecessary.

A riser disconnect system and method disclosed in U S. Patent Application Publication No. 2004/0173356 A1 filed by Dore et al. provides a way to move a floating drilling structure from a well location by enabling disconnecting the riser from the well. Such system and method have particular application for wells drilled from floating drilling structures where the BOP is located at the top of the riser on the floating drilling structure. However, the method and system disclosed in the Dore et al. publication requires that a disconnect device for the riser be located proximate the water bottom in order to prevent the riser from collapsing under its own weight when tensile force from the floating drilling structure is thus removed. Therefore, the method and system disclosed in the Dore et al. publication still require retrieval of a substantial length of riser below the floating drilling structure, which is time consuming as explained above.

A riser system having a BOP near the water bottom and including a riser disconnect is shown in U.S. Pat. No. 5,657,823 issued to Kogure et al. The system shown in the '823 patent provides a way to disconnect the riser at a relatively shallow depth in the water, described as 50 to 500 feet, to enable relatively quickly moving the floating structure away from the well area if a storm approaches. The system shown in the '823 patent includes buoyancy devices such as canisters that are affixed to the lower portion of the riser in the event the upper portion riser is to be disconnected from the floating platform. When the upper portion of the riser is disconnected from the lower portion, the buoyancy devices support the lower portion of the riser in tension. It can be time consuming and difficult to affix buoyancy devices to a riser when it is deployed in the water.

What is needed is an improved method and system to reduce the amount of time needed to make adverse weather preparations for a floating drilling or production platform.

SUMMARY OF THE INVENTION

One aspect of the invention is a method for preparing to move a floating structure away from a wellbore drilled below the bottom of a body of water. A method according to this aspect of the invention includes filling a riser extending from the bottom of the body of water to the floating structure with water. The water in the riser is displaced with gas to a selected first depth below the water surface. The riser is sealed at a second selected depth shallower than the first selected depth. The portion of the riser above the second selected depth is withdrawn onto the floating structure.

Other aspects and advantages of the invention will be apparent from the following description and the appended claims.

DETAILED DESCRIPTION

Figure 1:
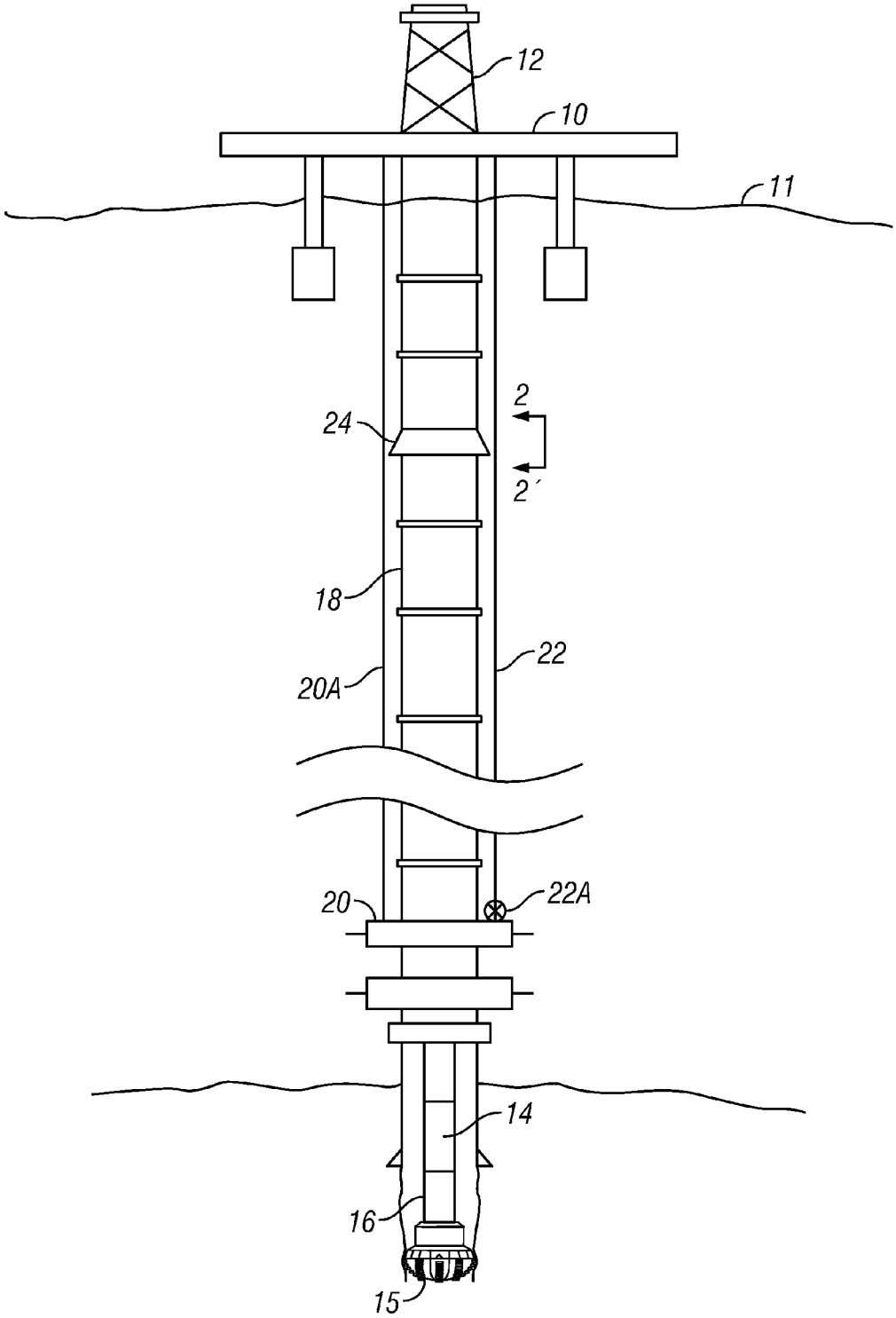
FIG. 1 shows a floating drilling platform drilling a wellbore in the Earth's subsurface below the bottom of a body of water including a riser disconnect disposed at a selected depth below the water line.

Various embodiments of the invention are explained herein in the context of drilling operations from a floating drilling platform. However, it should be clearly understood that methods and systems according to the invention are also applicable to floating production systems, and thus, application of the method according to the present invention to drilling is not a limitation on the scope thereof. FIG. 1 shows a floating drilling platform 10, such as a semisubmersible drilling rig or a drill ship, on the surface of a body of water 11 such as the ocean as the platform is used for drilling a wellbore 16 in subsurface Earth formations 17 below the bottom 11A of the body of water 11. The wellbore 16 is drilled by a drill string 14 that includes (none of which shown separately) segments of drill pipe threadedly coupled end to end, various stabilizers, drill collars, heavy weight drill pipe, and other tools, all of which may be used to turn a drill bit 15 disposed at the bottom end of the drill string 14. As is known in the art, drilling fluid is pumped down the interior of the drill string 14, exits through the drill bit 15, and is returned to the platform 10 for processing. A riser 18 connects the upper part of the wellbore 16 to the floating platform 10 and forms a conduit for return of the drilling fluid. Wellbore fluid pressure control equipment, collectively referred to as a blowout preventer (BOP) and shown generally at 20 includes sealing elements (not shown separately) to close the wellbore 16 below the BOP 20 in the event closing the wellbore 16 becomes necessary. The BOP 20 is controlled from the platform 10 by suitable control lines 20A known in the art.

In the present embodiment, the riser 18 may include a booster line 22 coupled near the BOP end thereof or to the BOP 20 selectively opened and closed by a booster line valve 22A. The booster line 22 forms another fluid path from the platform 10 to the wellbore 16 at a depth proximate the BOP 20. The purpose for the booster line 22 and valve 22A as related to the invention will be further explained below. The riser 18 also includes therein a riser disconnect 24 of any type well known in the art, such as may be obtained from Cooper Cameron, Inc., Houston Tex. The disconnect 24 is disposed in the riser 18 at a selected depth below the water surface. The riser disconnect 24 is preferably located at the shallowest depth in the water that is substantially unaffected by action of storms on the water surface. Such depth is presently believed to be about 500 feet. As will be further explained below, when storm preparations are made, the riser 18 may be uncoupled at the riser disconnect 24, hydraulically sealed, and the upper section of the riser 18, from the disconnect 24 to the surface may be retrieved onto the floating platform 10, whereupon the platform 10 may be moved from the location for safety.

In a method according to the invention, the riser 18 can be partially filled with gas to a selected depth. Such depth is preferably selected such that the gas in the riser 18 will reduce the weight of the riser 18 in the water 11 so as to provide the portion of the riser 18 below the disconnect 24 with sufficient buoyancy to support the weight of the riser 18 below the disconnect 24. Such support may require additional buoyancy, such as can be provided by air cans (not shown) or other buoyancy device known in the art, however the principle is that the additional buoyancy provided by gas displacement within the riser 18 will enable disconnection from the riser 18 of the tensile force otherwise provided by the platform 10 to the riser 18. Where the riser disconnect 24 is located about 500 feet below the water surface, it is contemplated that the displacement of the liquid in the riser 18 with gas should take place to a depth of about 2,500 feet from the water surface. If the riser disconnect 24 is placed about 500 feet below the water surface, the displacement depth would thus be about 2,000 feet below the riser disconnect 24. The particular depth to which gas should displace liquid in the riser 18 will depend on the weigh in water of the particular riser and the length of the riser below the disconnect 24.

In one embodiment of a method according to the invention, to prepare the wellbore 16 and the riser 18 for moving the platform 10 from the location, first the drill string 14 is lifted out of the wellbore 16 such that it is above the BOP 20. The BOP 20 is then closed to seal the wellbore 16 below the BOP 20. When the BOP 20 is closed, the control line 20A may be retrieved therefrom and withdrawn to the platform 10. Then, the drilling fluid in the riser 18 is displaced with sea water. In one implementation, the sea water is pumped into the interior of the drill string 14 so as to displace all the drilling fluid in the riser 18 up the annular space between the drill string 14 and the riser 18. By displacing all the drilling fluid, which may have a specific gravity of as much as 2.2 or more, the weight of the riser 18 in the water 11 is reduced. After the drilling fluid in the riser 18 is displaced, the drill string 14 is withdrawn from the riser 18 and a riser fluid displacement and riser sealing tool can be coupled to the drill string. A more detailed view of the riser 18 near the position of the disconnect 24, and the disconnect 24, itself are shown in FIG. 2 along with one embodiment of a riser fluid displacement and sealing tool that may be used with a method according to the invention.

Figure 2:
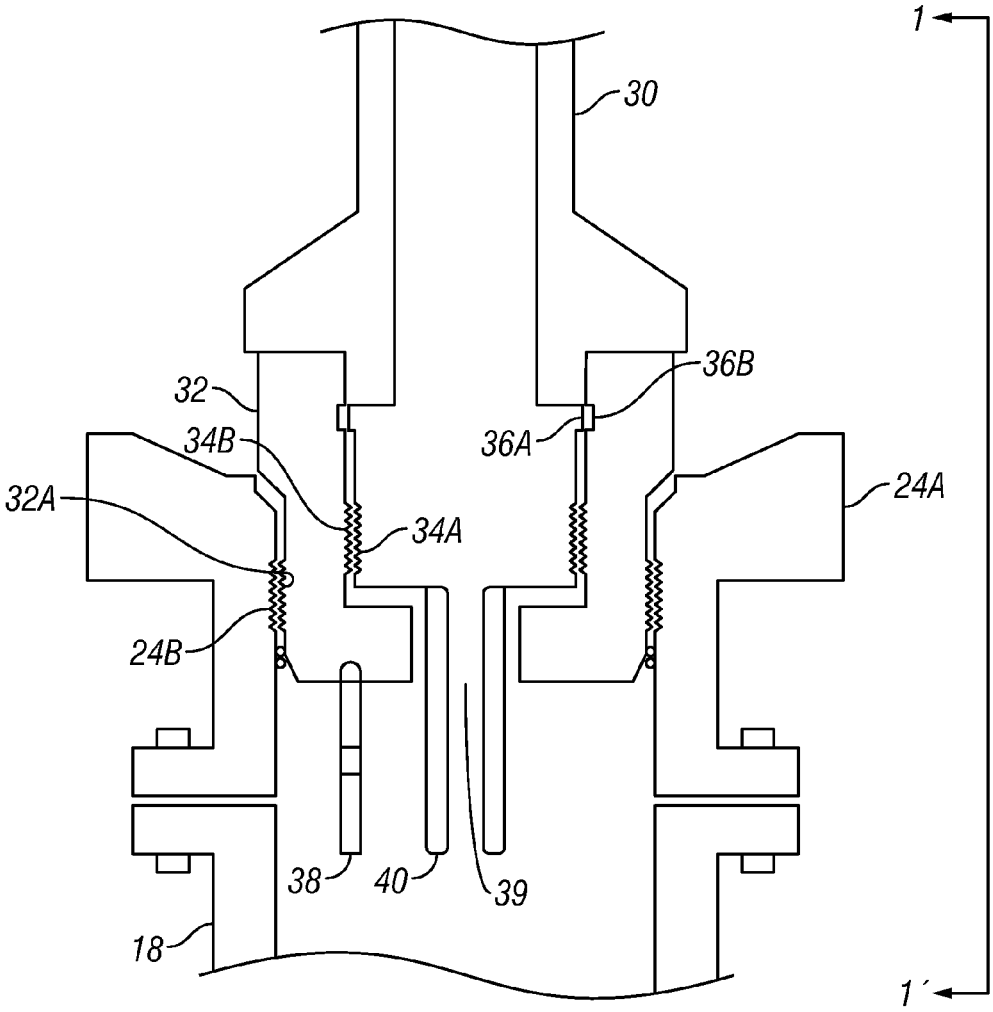
FIG. 2 shows a more detailed view of the riser disconnect, and a special tool for sealing the riser to fluid pressure.

Referring to FIG. 2, the displacement and riser sealing tool in one embodiment may include a running tool, shown generally at 30, that may be threadedly coupled to the lower end of the drill string (14 in FIG. 1). A sealing element, shown generally at 32, may be itself threadedly coupled to the running tool 30. The sealing element 32 may include external threads 32A thereon to mate with corresponding internal threads 24B in a lower portion 24A of the riser disconnect 24. The sealing element 32 includes an opening 39 in the bottom thereof to enable passage of fluids therethrough. The opening 39 is sealed by a flapper valve 38 or the like that closes automatically when the running tool 30 is withdrawn from the sealing element 32. The running tool 30 may include a J-slot engagement device for coupling to the sealing element 32 to the running tool 30 during the procedure of inserting the sealing element 32 into the riser 18. The J-slot engagement device is formed from two components, one shown on the running tool at 36A and the other shown on the sealing element 32 at 36B. During insertion of the sealing element 32, the sealing element 32 is affixed to the running tool 30 by the J-slot device 36A, 36B. The running tool 30 and sealing element 32 are lowered into the lower portion 24A of the riser disconnect 24 at the end of the drill string (14 in FIG. 1) and the sealing element 32 is threadedly engaged to the lower portion 24A using the corresponding threads 32A, 24B by rotating the drill string (14 in FIG. 1). In the present embodiment, the corresponding threads 32A, 24B are left handed, the reason for which will be explained below.

The interior of the drill string (14 in FIG. 1) may then be charged with gas, such as nitrogen, under pressure contemporaneously with opening the booster line valve (22A in FIG. 1). The gas flows through the drill string (14 in FIG. 1), outward from the opening 39, and by action of the gas pressure displaces the water in the riser 18 (which upon displacement travels upwardly through the booster line 22) downwardly to a selected depth, which as previously explained may be about 2,000 feet below the riser disconnect 24. The water leaves the riser 18 through the booster line (22 in FIG. 1) and moves back toward the platform (10 in FIG. 1). The booster line valve (22A in FIG. 1) is then closed, and the drill string (14 in FIG. 1) can be withdrawn from the riser 18 by disengaging the running tool 30 from the sealing element 30. Such disengagement may be performed by suitable axial and rotational movement thereof to disengage the J-slot device 36A, 36B. When the running tool 30 is withdrawn from the sealing element 32, the flapper valve 38 closes, thus hydraulically sealing the riser 18. The riser disconnect 24 may then be operated in the manner known in the art, and the portion of the riser 18 above the riser disconnect 24 can be withdrawn from the water and placed on the platform (10 in FIG. 1).

After any storm danger has passed, the upper portion of the riser 18 may be reengaged with the lower portion thereof by engaging the components of the riser disconnect 24 in the manner known in the art. The sealing element 32 may be removed from the riser disconnect 24 by again affixing the running tool 30 to the drill string (14 in FIG. 1), and moving the running tool 30 such that it engages the sealing element 32. In removing the sealing element 32, the J-slot devices are not used, but instead, corresponding threads 34A, 34B on the running tool 30 and the sealing element 32, respectively, are engaged by rotating the drill string (14 in FIG. 1) clockwise. The corresponding threads 34A, 34B are right-handed, and thus opposite-handed to the threads 24B on the lower portion 24A of the riser disconnect 24 and the corresponding threads 32A on the sealing element 32. Therefore, continuing drill string rotation in the direction (clockwise in the present embodiment) that engages the threads 34A, 34B between the running tool 30 and sealing element 32 disengages the corresponding threads 32A, 24B between the sealing element 32 and the riser disconnect 24. The drill string (14 in FIG. 1) may then be withdrawn from the riser 18, with the running tool 30 and sealing element 32 attached at the bottom end thereto, and normal drilling operations may resume.

In water depths of several thousand feet or more, it is therefore only necessary to remove the length of riser 18 to a depth just below that to which storm effects descend. As an example, only the topmost 500 feet of riser is expected to be withdrawn to the platform (10 in FIG. 1), leaving the entire lower portion of the riser self-suspended by enough buoyancy to avoid collapse thereof. Such procedure is expected to take only a few hours, as contrasted with the several days it may take to withdraw the entire riser from the water.

The embodiment explained above with reference to FIG. 2 in which the riser is displaced by pumping gas therein is only one method for displacement. In other embodiments, suitable "swab" devices may be affixed to the lower end of the drill string such that the water in the riser may be lifted out of the riser by motion of the drill string.

Methods according to the invention can substantially reduce the time necessary to prepare a floating platform for storm evacuation, and can reduce the number of times the preparations are made unnecessarily by shortening such preparation time.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for preparing to move a floating structure away from a wellbore drilled below the bottom of a body of water, comprising:

filling a riser extending from the bottom of the body of water to the floating structure with water;

displacing the water in the riser to a first selected depth below the water surface, the displacing including discharging the water through a selectively controllable outlet in hydraulic communication with an interior of the riser at a depth below the first selected depth, an elevation difference between the first selected depth and a second selected depth shallower than the first selected depth providing the riser, when filled with gas, sufficient buoyancy to buoyantly support all the riser in the water below the second selected depth;

closing the selectively controllable outlet;

sealing the riser at the second selected depth; and withdrawing the portion of the riser above the second selected depth onto the floating structure.

2. The method of claim 1 wherein the water at the second selected depth is substantially unaffected by storm activity on the surface of the water.

3. The method of claim 1 wherein the displacing the water comprises pumping gas into the riser.

4. The method of claim 3 wherein the gas comprises nitrogen.

5. The method of claim 1 wherein the selectively controllable outlet comprises a booster line extending from a depth proximate a lower end of the riser to the water surface and a booster line control valve proximate a lower end of the booster line.

6. The method of claim 1 wherein the displacing water in the riser comprises extending a pipe string into the interior of the riser, the pipe string having a sealing element and running tool attached at an end thereof such that the sealing element and running tool engage a mating device in an interior of the riser, and pumping gas through an interior of the pipe string.

7. A method for preparing to move a floating structure away from a wellbore drilled below the bottom of a body of water, comprising:

filling a riser extending from the bottom of the body of water to the floating structure with water;

displacing the water in the riser to a first selected depth below the water surfaces, the displacing including discharging the water through a selectively controllable outlet in hydraulic communication with an interior of the riser at a depth below the first selected depth;

closing the selectively controllable outlet, the selectively controllable outlet comprising a booster line extending from a depth proximate a lower end of the riser to the water surface and a booster line control valve proximate a lower end of the booster line;

sealing the riser at a second selected depth shallower than the first selected depth; and withdrawing the portion of the riser above the second selected depth onto the floating structure.

8. The method of claim 7 wherein an elevation difference between the first selected depth and the second selected depth provides the riser, when filled with gas, sufficient buoyancy to buoyantly support all the riser in the water below the second selected depth.

9. The method of claim 7 wherein the water at the second selected depth is substantially unaffected by storm activity on the surface of the water.

10. The method of claim 7 wherein the displacing the water comprises pumping gas into the riser.

11. The method of claim 10 wherein the gas comprises nitrogen.

12. The method of claim 7 wherein the displacing water in the riser comprises extending a pipe string into the interior of the riser, the pipe string having a sealing element and running tool attached at an end thereof such that the sealing element and running tool engage a mating device in an interior of the riser, and pumping gas through an interior of the pipe string.

13. A method for preparing to move a floating structure away from a wellbore drilled below the bottom of a body of water, comprising:

filling a riser extending from the bottom of the body of water to the floating structure with water;

displacing the water in the riser to a first selected depth below the water surfaces, the displacing including discharging the water through a selectively controllable outlet in hydraulic communication with an interior of the riser at a depth below the first selected depth, the displacing water in the riser comprising extending a pipe string into the interior of the riser, the pipe string having a sealing element and running tool attached at an end thereof such that the sealing element and running tool engage a mating device in an interior of the riser, and pumping gas through an interior of the pipe string;

closing the selectively controllable outlet;

sealing the riser at a second selected depth shallower than the first selected depth; and withdrawing the portion of the riser above the second selected depth onto the floating structure.

14. The method of claim 13 wherein an elevation difference between the first selected depth and the second selected depth provides the riser, when filled with gas, sufficient buoyancy to buoyantly support all the riser in the water below the second selected depth.

15. The method of claim 13 wherein the water at the second selected depth is substantially unaffected by storm activity on the surface of the water.

16. The method of claim 13 wherein the displacing the water comprises pumping gas into the riser.

17. The method of claim 16 wherein the gas comprises nitrogen.

18. The method of claim 13 wherein the selectively controllable outlet comprises a booster line extending from a depth proximate a lower end of the riser to the water surface and a booster line control valve proximate a lower end of the booster line.

* * * * *